United States Patent [19]

Koizumi et al.

[11] Patent Number: 4,737,344

[45] Date of Patent: Apr. 12, 1988

[54] LIQUID SAMPLE-SPOTTING APPARATUS

[75] Inventors: Teruaki Koizumi; Takeshi Igarashi; Masao Kitajima, all of Asaka, Japan

[73] Assignee: Fuji Photo Film Co., Ltd., Kanagawa, Japan

[21] Appl. No.: 42,596

[22] Filed: Apr. 22, 1987

Related U.S. Application Data

[63] Continuation of Ser. No. 850,076, Apr. 8, 1986, abandoned, which is a continuation of Ser. No. 695,124, Jan. 25, 1985, abandoned.

[30] Foreign Application Priority Data

Jan. 25, 1984 [JP] Japan ..... 59-11396

[51] Int. Cl.[4] ..... B01L 3/02

[52] U.S. Cl. ..... 422/100; 73/864.24; 141/275; 222/325; 222/420; 422/104

[58] Field of Search ..... 422/100, 104; 222/325, 222/420; 73/864.24; 141/275

[56] References Cited

U.S. PATENT DOCUMENTS 3,915,651 10/1975 Nishi ..... 422/100 X

FOREIGN PATENT DOCUMENTS 2800771 7/1979 Fed. Rep. of Germany ..... 422/100

*Primary Examiner*—Arthur Kellogg

*Attorney, Agent, or Firm*—Jules E. Goldberg

[57] ABSTRACT

A liquid sample-spotting apparatus having a base, a holder which is mounted on the base by an elastic body such as a spring in such a manner that said holder is movable downward against an action of the elastic body for recovering the original form, and a manually operable micropipette which is detachably supported by the holder. A process for spotting a liquid sample on an analytical element using said apparatus, which comprises steps of moving downward the holder and the micropipette with a droplet of the liquid sample formed on the pointed end against the recovering action of the elastic body; stopping the downward movement of the micropipette when the droplet of the liquid sample bridges the micropipette and the surface of the analytical element to spot the droplet on the element; and elevating the micropipette to the original position by the recoverable action of the elastic body.

6 Claims, 3 Drawing Sheets

LIQUID SAMPLE-SPOTTING APPARATUS

This is a continuation of application Ser. No. 850,076, filed Apr. 8, 1986, which, in turn, is a continuation of application Ser. No. 695,124, filed Jan. 25, 1985, both now abandoned.

BACKGROUND OF THE INVENTION

1. Field of the Invention

The present invention relates to a liquid sample-spotting apparatus, and more particularly pertains to a liquid sample-spotting apparatus for use in spotting a given trace amount of a liquid sample on a sheet-form chemical analytical element for clinical tests by means of a micropipette. Further, the invention relates to a process for spotting a liquid sample on an analytical element using said apparatus.

2. Description of Prior Arts

Various body fluids are used as test solutions in clinical tests, and the most important test solution is blood. From the nature of the test solutions, it is important to use a small amount or a trace amount of a sample, and 5 μl to 100 μl of the solution is generally subjected to analysis. It will be understood that in measuring a trace amount of a sample an error in the amount of a solution to be measured relatively increases with a reduction in the amount to be measured.

However, when a sheet-form chemical analytical element having the outermost layer composed of a spreading layer capable of uniformly spreading the aqueous solution is used, it is evident that fluctuations in measured values caused by the valiability of the amount of the test sample to be measured are greatly reduced and measuring accuracy is remarkably improved as compared with solution methods which have been conventionally carried out. Accordingly, the sheet-form chemical analytical element is particularly suitable for use in the analysis of a trace amount of a sample. A micropipette is usually used for measuring such trace amount of sample solution.

In analytical operations using said sheet-form chemical analytical element, it has been found that measured results are affected by a spotting mode in depositing a small amount of the liquid solution in the form of a spot on the outermost layer composed of a porous membrane. More particularly, in spotting the liquid solution on the surface of the sheet-form chemical analytical element after taking a given amount of the liquid solution into a micropipette, the spreading conditions of the liquid solution in the porous membrane are influenced by the type of spotting operations, for example, a mode of dropping a liquid droplet on the membrane, a mode of directly depositing the sample on the membrane, and a mode of rubbing the sample against the membrane. Thus, fluctuations in the measured values increase.

Japanese Utility Model Provisional Publication No. 56(1981)-146241 discloses a liquid sample spotting apparatus which can keep the optimum operational conditions for spotting the liquid sample on the spreading layer of the sheet-form chemical analytical element with a manually operable micropipette and can reduce an operational error or an error due to an individual difference in order to minimize errors caused by the spotting conditions at the time of spotting the liquid sample. Since the liquid sample in this apparatus is caused to drop on the spreading layer of the sheet-form chemical analytical element, air bubbles may disadvantageously form within or on the surface of the liquid droplet supplied to said spreading layer so that the spreading conditions of the liquid sample within the spreading layer are adversely affected and fluctuations in the measured values increase.

TECHNICAL BACKGROUND OF THE INVENTION

When a given amount of a body fluid sample, such as serum or whole blood is deposited on the sheet-form chemical analytical element by means of a micropipette, the spotting conditions must be always proper in order to obtain results with good reproducibility and high accuracy. For example, when an analytical slide shown in FIGS. 1 and 2 (only an integral multilayer chemical analytical element to be put in a slide frame is shown and the slide frame is not shown) is used, spotting must be carried out under conditions such that the area to be spotted is nearly the center of the analytical slide and the liquid sample can be spread almost uniformly over the surface of the analytical element. It has been found from experimental results that when the sample solution is spotted with a micropipette, the best results can be obtained under conditions such that a liquid droplet is formed on the tip of the micropipette and the whole amount thereof is gently supplied to the surface of the analytical element.

It has been further found that it is preferred to apply onto the element the droplet of the liquid sample formed on the pointed end of the micropipette in such a manner that a portion of the droplet up to $\frac{1}{3}$ or longer of the vertical length of the droplet measured from the lowest level of the droplet is contacted with the spreading layer of the sheet-form chemical analytical element before removing the micropipette. Using this operation, the whole amount of the liquid droplet is spotted gently to the spreading layer. The size as well as the length in the vertical direction of the droplet of the liquid sample formed on the pointed end of the micropipette varies depending on the type of the liquid sample, the shape and the diameter of the pointed end of the micropipette and the nature of the materials thereof. It has been found that it is desirable that the pointed end of the micropipette at the spotting position of the liquid sample is speced away from the spreading layer by a gap meeting the aforementioned requirements on the basis of the length of the liquid droplet in the vertical direction.

Spotting conditions for obtaining good analytical results are greatly influenced by the physical properties, particularly viscosity, of the liquid sample and the affinity of said liquid sample to the surface of the analytical element. For example, when a low-viscosity liquid such as urine is used as a sample, similar results can be obtained even when spotting is conducted by dropping, while when a high-viscosity liquid such as blood, particularly whole blood is used as a sample, it is difficult to carry out dropping with good reproducibility. Better results can be obtained only by gently contacting the sample with said element. In any case, it is difficult to constantly control the spotting conditions, there is a limitation in relying on operator's experience and skill, and particularly errors are liable to be caused when spotting is made by different operators.

OBJECT OF THE INVENTION

It is an object of the present invention to provide a liquid sample spotting apparatus which can keep the optimum conditions for spotting a liquid sample without forming any air bubbles within the liquid droplet of said liquid sample in spotting said liquid sample on a sheet-form chemical analytical element with a manually operable micropipette, can minimize an operational error or an error due to an individual difference, enables the spotting of the liquid droplet of the liquid sample to be constantly carried out under the optimum conditions by a simple and rapid operation, can control the vertical position of the micropipette by a simple structure, hence can keep the micropipette at a proper position according to the type of the liquid sample, can smoothly conduct the elevating reset movement of the micropipette and can prevent the tip of the micropipette from being damaged.

SUMMARY OF THE INVENTION

The present invention provides a liquid sample-spotting apparatus having a base, a holder which is mounted on said base by an elastic body in such a manner that said holder is movable downward in the vertical direction against an action of the elastic body for recovering the original form, and a manually operable micropipette which is detachably supported by said holder.

The above-described apparatus can be employed in a process for spotting a liquid sample on an analytical element, which comprises steps of:

moving downward said holder and the micropipette with a droplet of the liquid sample formed on the pointed end against an action of the elastic body for recovering the original form;

stopping the downward movement of the micropipette when the droplet of the liquid sample bridges the micropipette and the surface of the analytical element placed under the micropipette to spot the droplet on the element with no contact between the pointed end of the micropipette and the surface of the analytical element; and elevating the micropipette to the original position by an action of the elastic body for recovering the original form.

BRIEF DESCRIPTION OF THE DRAWINGS

FIGS. 4 to 7 show an embodiment of the liquid sample-spotting apparatus of the invention wherein FIG. 4 is a front view, FIG. 5 is a right side view, and each of FIGS. 6 and 7 is a right side view for illustrating operations.

DETAILED DESCRIPTION OF THE INVENTION

Figure 1:
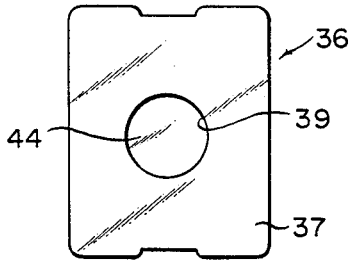
FIG. 1 is a plain view showing an embodiment of a slide enclosing a chemical analytical element therein on which a liquid sample is spotted by the liquid sample-spotting apparatus of the present invention.

The term "liquid sample" used herein refers to aqueous solutions, particularly body fluids to be subjected to clinical tests, including blood, urine, saliva, spinal fluid, intestinal juice, pancreatic juice and the like as well as their diluted solutions prepared as analytical samples.

The term "spotting" used herein refers to an operation comprising depositing (or supplying) dropwise an approximately predetermined amount of a liquid sample in the form of spot on the surface of a sheet-form chemical analytical element, or supplying an approximately predetermined amount of said liquid sample in the form of a spot to the surface of said chemical analytical element by gently bringing said liquid sample into contact with said element.

The term "micropipette" used herein refers to various kinds of pipettes capable of pipetting 100 μl or less of the sample.

The term "sheet-form chemical analytical element" used herein refers to sheet-form dry analytical elements intended for the analysis of specific components (i.e., analyte) contained in body fluids in the field of clinical test, including those in the form of a strip, a film and a sheet. The analytical element is generally used in the form of a slide-form chemical analytical slide in which the element is put in a frame (slide frame) made of paper or a plastic material.

The sheet-form or slide-form analytical elements for clinical test are described in the literature "Clinical Test", Vol. 22 (extra edition), pages 1203–1218, written in Japanese, and are being widely put to practical use as a rapid and simple analytical method for clinical test.

Examples of multilayer chemical analytical elements which can be used in the present invention include integral analytical elements disclosed in, for example, Japanese Patent Provisional Publication Nos. 49(1974)-53888, 50(1975)-137192, 51(1976)-40191, 52(1977)-3488, 52(1977)-141786, 52(1977)-142584 and 55(1980)-33651, Japanese Patent Application Nos. 54(1979)-173624 and 55(1980)-435, etc. These multilayer chemical analytical elements have a sheet structure wherein one or more reagent layers and porous spreading layers are laminated onto a water-impermeable support to integrate them. When a given amount of a liquid sample is allowed to drop on the spreading layer or the outermost of such a sheet-form chemical analytical element, the liquid sample penetrates into lower layers, while the liquid sample is spread over a given area, where a reaction, for example, a color forming reaction proceeds in proportion to the amount of a substance to be analyzed. The content of said substance present in the liquid sample is detected and determined by conducting the photometry of color density after the lapse of a given time. Such a sheet-form chemical analytical element is characterized in that the outmost layer thereof comprises a porous membrane capable of uniformly spreading the liquid solution. The characteristics and the materials thereof are described in more detail in Japanese Patent Provisional Publication Nos. 49(1974)-53888, 55(1980)-90859, 55(1980)-164356, 57(1982)-148250, etc.

A mechanism for automatically supplying a given amount of a liquid sample to such a multilayer chemical analytical element with an exclusive cup is disclosed in U.S. Pat. No. 4,142,656 wherein the support of the multilayer chemical analytical element is raised toward a liquid sample supply port so as to bring the liquid droplet into contact with the surface layer of the multilayer chemical analytical element in carrying out the spotting of the liquid sample. Another embodiment for raising the support to bring the liquid droplet of the liquid sample into contact with the surface layer of the multilayer chemical analytical element is disclosed in U.S. Pat. No. 4,041,995.

The present invention will be described in more detail with reference to the accompanying drawings.

Figure 4:
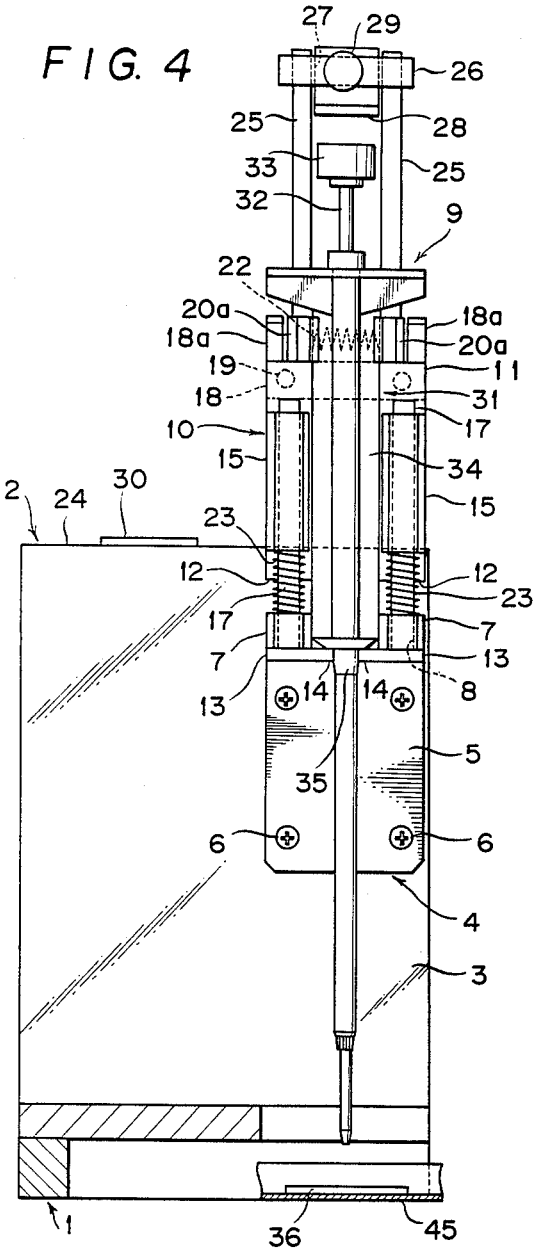
Figure 5:
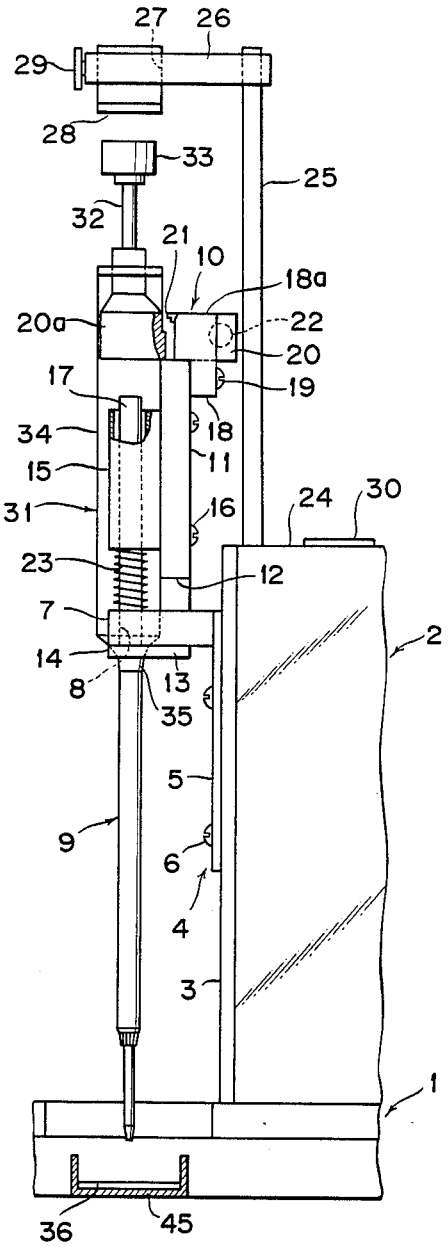

Referring to FIGS. 4 and 5, a box 2 is mounted on a base 1, and the vertical plate 5 of a stationary plate 4 is screwed to the side plate 3 of the box 2 by screws 6. The fixed plate 4 is provided with a forked guide member 7 horizontally protruding at the upper part of the vertical plate 5. Through-holes 8 are vertically formed through the guide member 7. A holder 10 for a manually operable micropipette 9 is supported by the stationary plate 4 in such a manner the holder 10 can be moved in the vertical direction. The holder 10 is provided with notches 12 on both sides of the lower parts of a vertical plate 11. There is provided protruding interlocking parts 13 on the front sides of the lower parts of these notches 12. Holding parts 14 are oppositely provided inside these interlocking parts 13. Above each notch 12 on the front side of the vertical plate 11, a pair of longitudinally extending positioning protrusions 15 are fixed by screws 16. A guide shaft 17 is fixed between each positioning protrusion 15 and each interlocking part 13. Above the vertical plate 11, a supporting plate 18 is fixed by screws 19 and supporting parts **18*a* on both sides of the supporting plate 18 are protruded from the vertical plate 11** on both sides thereof.

Above the vertical plate 11, there is provided a pair of holding pieces 20, and the intermediate part of the holding pieces 20 is rotatably supported by a vertical shaft 21, that is, the holding parts **20*a* are switchably (on-off operatably) supported, a compression spring 22 serving as an elastic body is provided between these holding pieces 20, and the holding parts 20*a* of the holding pieces 20 are energized in the direction of blockade by the spring of the compression spring 22. The holding parts 20*a* are expanded against the spring of the compression spring 22. The holder 10 is inserted so that when the notches 12 are interlocked with the guide parts 7, the guide shafts 17 are slidably inserted into the through-holes 8 formed within the guide part 7 of the stationary plate 4. A compression spring 23 serving as an elastic body and inserted into the guide shaft 17 is interposed between the positioning protrusion 15 and the guide part 7. The holder 10 is energized upward by the spring of these compression springs 23 and the ascending of the holder is regulated by the interlocking of the part 13 with the under surface of the guide part 7, while when the holder 10 is pushed downward, the holder 10 can be descended against the spring of the compression spring 23, and the descending thereof is regulated by the interlocking of the upper edge of the notch 12 with the upper surface of the guide part 7 (see, FIG. 7). A pair of operating shafts 25 (on the right and the left) extends through the upper plate 24 of the box 2 and is vertically movably supported, and a supporting plate 26 is horizontally provided at the upper protruding edge of the operating shaft 25**.

Above the holding parts 20, a pushing member 28 is inserted into the hole 27 of the supporting plate 26, and fixed to the supporting plate 26 by a screw 29. A motor (not shown) provided within the box is connected through a power transmission mechanism such as a cam (not shown) to the operating shafts 25. When a switch 30 is on to drive the motor, there are intermittently moved up and down the operating shafts 25, the supporting plate 26 and the pushing member 28.

A piston 32 supported by the main body 31 is made to descend against the spring of a compression spring (not shown) by depressing a knob 33, whereby the top of the manually operable micropipette 9 is inserted into a liquid sample. The knob 33 is then released, whereby the piston is reset upward by the spring of the compression spring and the micropipette sucks up the liquid sample. When the micropipette is moved in parallel with axis, the upper enlarged part 34 of the main body 31 is inserted into the inner side of the guide parts 7 and the positioning protrusions 14 and the holding parts **20*a* of the holding pieces 20 are expanded against the spring of the compression spring 22, the micropipette can be elastically supported by the holding parts 20*a* and the lower narrow part 35 of the main body 31 can be forcedly inserted into the inner side of holding parts 14**, thus holding the micropipette.

Figure 2:
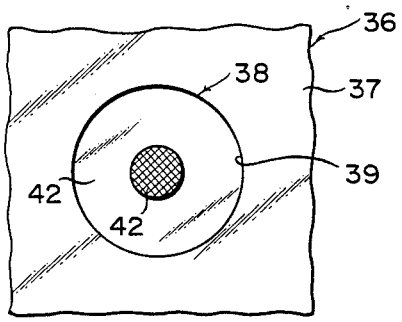
FIG. 2 is a partially enlarged cross-sectional view for illustrating a state where a given volume of a liquid droplet of the liquid sample is spotted on the surface of the chemical analytical element by the micropipette.
Figure 3:
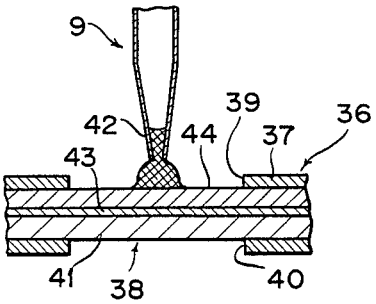
FIG. 3 is an enlarged plain view together with a developed view for illustrating the spotting of the liquid sample on the chemical analytical element and the development of the spotted liquid sample thereon.

A chemical analytical slide 36 comprises a thin plastic frame 37 and a sheet-form multilayer chemical analytical element 38, for example, as shown in FIGS. 1 to 3. The frame 37 has a liquid sample dropping hole 39 at the central part of the upper surface thereof and a photometric hole 40 at the central part of the lower surface thereof. The multilayer chemical analytical element 38 comprises a water-impermeable transparent support 41, a reagent layer 43 (provided on said support 41) and a porous spreading layer 44 (provided on said reagent layer 43), said reagent layer 43 containing a reagent capable of producing optically detectable change (e.g. optical reflection density) by a chemical reaction, for example, by a color reaction in proportion to the amount of an analyte contained in a liquid sample 42 and the spreading layer 44 being designed so as to supply approximately a given amount of the liquid sample per unit area to the reagent layer 43. The measuring element 38 is held in the frame 37 in such a manner that the porous spreading layer is turned upward.

The following description refers to an embodiment using the liquid sample spotting apparatus of the present invention wherein the base 1 of the spotting apparatus is fixed to the frame (not shown) of the incubator of the chemical analytical device described in Japanese Patent Provisional Publication No. 58(1983)-21566.

Figure 6:
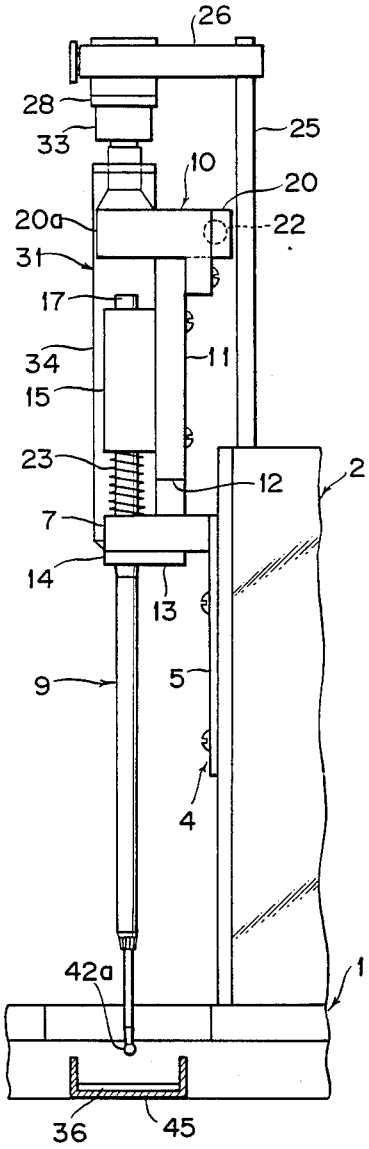
Figure 7:
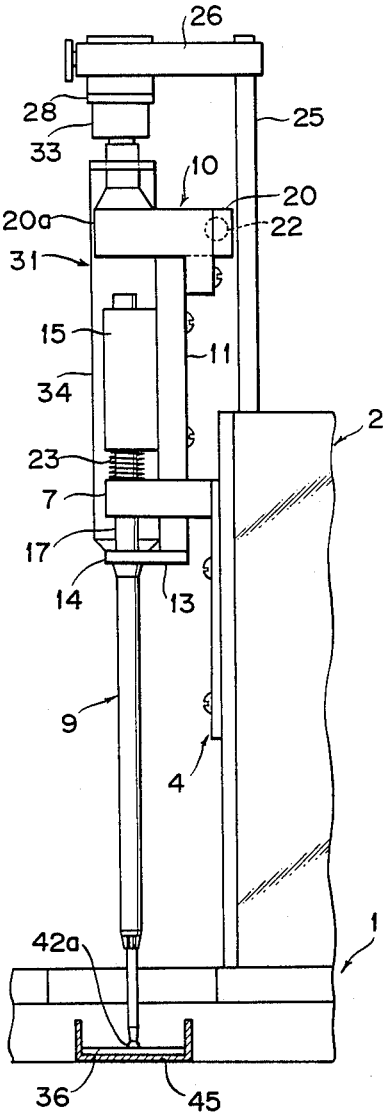

In the state wherein the micropipette 9 is held by the holder 10 and the micropipette 9 and the holder 10 are energized upward by the spring of the compression spring 10, the knob 33 of the micropipette 9 is pushed to thereby descend the piston 32, whereby the micropipette is set at a height such that the liquid sample sucked up is discharged and a liquid droplet **42*a* is formed at the tip of the chemical analytical element 38 and at a position spaced away from the porous spreading layer 44 (see, FIG. 6) and whereby the micropipette is set such that when the micropipette 9 and the holder 10 are made to descend against the spring of the compression spring 23, a portion of the liquid droplet 42*a*, preferably a portion corresponding to $\frac{1}{3}$ or longer of the length (measured from the lowest level of the droplet in the vertical direction) of the liquid droplet can be brought into contact with the spreading layer 44 of the chemical analytical element 38 to conduct gently spotting (see, FIGS. 3 and 7**).

The following description relates to an operation for spotting the liquid sample **42*a* on the chemical analytical slide 36** by using the apparatus of the invention.

A fresh chemical analytical element 36 is set in a regular state at a predetermined position within the sample supply passage 45 of the incubator as shown in FIGS. 4 and 5. A liquid sample to be measured, for body fluid is then taken into the micropipette 9. After taking the body fluid, the upper enlarged part 34 of the main body 31 of the micropipette 9 is forcedly press-fitted into the holding parts 20*a* of the holding pieces 20 to held it by the spring of the compression spring 22, and the lower narrow part 35 of the main body 31 is forcedly inserted into the inner side of the holding parts 14 to interlock the upper inclined part 35*a* thereof with the guide part 7, whereby the micropipette 9 is held so as not to descend against the holder 10. In this way, the micropipette 9 can be held by the upper position and the lower position so that it can be stabilized.

When the switch 30 is made on, the operating shafts 25, the supporting plate 26 and the pushing member 28 are descended by the power transmission mechanism by the driving of the motor. As shown in FIG. 6, the pushing member 28 pushes the knob 33 of the micropipette 9 by this descending to thereby make the knob 33 and the piston 32 to descend by the spring of the compression spring, whereby the body fluid 42 taken into the micropipette is squeezed out to form the liquid droplet 42*a* at the tip of the micropipette. When the knob 33 is still further pushed by the pushing member 28, the micropipette 9 together with the holder is made to descend against the spring of the compression spring 23 as shown in FIG. 7 until the micropipette reaches the sample spotting position where at least $\frac{1}{3}$ of the liquid droplet 42*a* formed on the tip thereof is brought into contact with the spreading layer 44 of the chemical analytical element 38 and the spotting of the liquid sample is effected (see, FIG. 3). Namely, after the liquid droplet 42*a* is formed on the pointed end(tip) of the micropipette 9, the spotting is carried out in such a manner that at least $\frac{1}{3}$ of the length (in the direction of movement, i.e., in the direction of gravity drop) is brought into contact with the spreading layer 44 so that the exactly predetermined volume of the body fluid is uniformly developed in the form of a concentric circle on the spreading layer 44 to spot it as shown in FIG. 2. After spotting, the operating shafts 25, the supporting plate 26 and the pushing member 28 are made to ascend, whereby the micropipette 9 and the holder 10 are lifted by the spring of the compression spring 23 to reset them as shown in FIG. 6. When the pushing member 28, etc. are further lifted and reset, the knob 33 and the piston 32 of the micropipette 9 are elevated to reset them. Meantime, the chemical analytical slide 36 after spotting is applied through a supply device (not shown) to the incubator, subjected to a photometric measurement and removed. By repeatedly carrying out the above operations, the spotting operation of the body fluid 42 on the chemical analytical slide 36 can be continuously carried out in order.

When the site to be spotted is variable or out of the center of the chemical analytical slide, the development is not uniform, unevenness in color formation is caused, or the photometric center does not coincide with the developed center so that the reproducibility of the measurement becomes poor and fluctuation in measured results are caused. However, when the spotting apparatus of the invention is used, the site to be spotted and the spotting conditions can be always controlled constant so that accuracy in the measurement using the integral multilayer chemical analytical element can be improved.

Since any of the holding pieces 20 on both sides is rotatably supported so as to allow them to be opened and closed in the embodiment described above, they may be constructed such that one of the holding pieces 20 is fixed and the other is rotatably supported so as to allow it to be opened and closed. In this case, for example, a tension spring is provided between a supporting part 18 and the rear end of the rotatable holding piece 20. As the manually operable micropipette 9, there may be used one provided with a detachable plastic tip at the top thereof. While in the above embodiment there has been illustrated the case where the liquid droplet formation and the spotting operation with the micropipette 9 are automatically carried out in the interlocking with the incubator, the knob 33 of the micropipette 9 may be pushed by the hand or the lock of the locked pressing member is released to make the pushing member descend or rotate by the spring of an elastic body such as a spring rotate by the spring of an elastic body such as a spring whereby the knob is pushed, or other means may be used.

Further, since in the apparatus of the present invention the liquid droplet can be formed on the tip of the micropipette 9, said tip being spaced away from the chemical analytical slide, a relatively much space between the chemical analytical slide 36 and the tip of the micropipette 9 can be left so that when the chemical analytical slide is automatically supplied to a chemical analyzer or an incubator put therein and removed therefrom, the micropipette 9 can be prevented from being damaged by the abutting of the chemical analytical slide supply device or the chemical analytical slide against the tip of the micropipette, said chemical analytical slide supply device including any of an inclined type and a planar type. The apparatus of the invention may be combined with the chemical analyzer or the incubator put therein, or may be separately provided.

While the specified embodiment has been described in some detail, it will be understood that modifications can be made without departing from the scope of the present invention.

EFFECT OF THE INVENTION

According to the present invention, a liquid droplet is formed on the pointed end of the micropipette and spaced away from the chemical analytical slide and the micropipette and the holder holding the micropipette are made to descend to bring the liquid drop into contact with the surface of the chemical analytical element so as to conduct gently spotting so that the spotting operation can be performed under the optimum conditions without forming any air bubbles in the liquid droplet at the time of spotting, an operational error or an error due to an individual difference can be minimized and the liquid droplet-spotting conditions can be always kept under the optimum conditions with a simple, rapid operation. Further, since the micropipette, etc. are energized upward by an elastic body, there are advantages that the descending position can be properly kept according to the kinds of the liquid sample by adjusting the pressing force against the micropipette, the ascending and resetting operations of the micropipette, etc. can be smoothly conducted and the pointed end of the micropipette can be prevented from being damaged.

We claim:

1. A liquid sample-spotting apparatus having a base, a holder which is mounted on said base by an elastic body in such a manner that said holder is movable downward in the vertical direction against an action of the elastic body for recovering its original form, and a manually operable micropipette equipped with a piston which is detachably supported by said holder, wherein said base has a pushing member for pushing said piston of the micropipette downward and then moving said holder together with said micropipette downward, and said holder and said base having cooperating means for stopping the downward movement thereof.

2. The liquid sample-spotting apparatus as claimed in claim 1, in which said holder has a means for keeping thereon said micropipette in such a manner that said micropipette is kept being free from horizontal vibration.

3. The liquid sample-spotting apparatus as claimed in claim 2, in which said means for keeping thereon the micropipette comprises a pair of holding pieces capable of opening and closing, and said holding pieces are energized in the direction of blockade by an elastic body.

4. The liquid sample-spotting apparatus as claimed in claim 1, in which said elastic body is a spring means bridging said base and holder.

5. A process for spotting a liquid sample on an analytical element using a liquid sample-spotting apparatus having a base, a holder which is mounted on said base by an elastic body in such a manner that said holder is movable downward in the vertical direction against an action of the elastic body for recovering its original form, and a manually operable micropipette equipped with a piston which is detachably supported by said holder, wherein said base has a pushing member for pushing said piston of the micropipette downward and then moving said holder together with said micropipette downward, and said holder has a means for stopping the downward movement thereof in conjunction with a means provided to said base, which comprises the steps of:

moving said pushing member downward to push said piston of the micropipette downward so as to form a droplet of a liquid sample contained in the micropipette at its pointed end and then moving said micropipette and holder together downward;

Stopping the downward movement of the micropipette when the droplet of the liquid sample bridges the pointed end of the micropipette and the surface of the analytical element placed under the micropipette to spot the droplet on the element while avoiding contact between the pointed end of the micropipette and the surface of the analytical element; and elevating the micropipette to its original position by an action of the elastic body for recovering its original form.

6. The process as claimed in claim 5 in which said elastic body is a spring means bridging said base and holder.

* * * * *